United States Patent [19]

Iato et al.

[11] 4,121,806

[45] Oct. 24, 1978

[54] APPARATUS FOR COMPENSATING VARIATIONS OF DISTANCE

[75] Inventors: Michel Iato, Pau; Andre Gaston Julien Bourgeois; Jean-Paul Marcel Francois Gaudin, both of Nantes, all of France

[73] Assignee: Societe Nationale Elf Aquitaine (Production), Courbevoie, France

[21] Appl. No.: 778,942

[22] Filed: Mar. 18, 1977

[30] Foreign Application Priority Data

Mar. 18, 1976 [FR] France ..... 76 07913

[51] Int. Cl.[2] ..... B66D 1/48

[52] U.S. Cl. ..... 254/172; 60/413; 175/27

[58] Field of Search ..... 254/172, 173 R; 60/413, 60/416, 418; 175/5, 27; 91/390; 267/124, 125

[56] References Cited

U.S. PATENT DOCUMENTS

| | | | |
|---|---|---|---|
| 3,693,939 | 9/1972 | Buckson | 254/172 |
| 3,871,622 | 3/1975 | Larralde et al. | 254/172 |
| 3,891,038 | 6/1975 | Delegtnade et al. | 254/172 |
| 3,905,580 | 9/1975 | Hooper | 254/172 |
| 3,912,227 | 10/1975 | Meeker et al. | 254/172 |
| 3,948,486 | 4/1976 | Jourdan et al. | 254/172 |

*Primary Examiner*—Trygve M. Blix
*Assistant Examiner*—Kenneth Noland
*Attorney, Agent, or Firm*—Melville, Strasser, Foster & Hoffman

[57] ABSTRACT

Apparatus for compensating for variations in the distance between an object or load suspended by a string of rods from a floating support or vessel and the sea floor therebelow so as to control the movement of the object or load with respect to the sea floor. There is both active and passive compensation provided by respective cylinder and piston assemblies associated with pressure accumulators. The passive compensation acts like spring. The active cylinder and piston assembly is of the double action type and disposed in parallel with the passive assembly. The active assembly compensates for residual vertical oscillations and operates as a function of two parameters : the position of the piston rod with respect to the cylinder of the active assembly and the velocity of the floating support with respect to the sea floor. Hydraulic control means operative in accordance with the parameters is connected to variable chambers of the active cylinder divided by its piston for varying the direction and flow rate of hydraulic fluid delivered thereto.

4 Claims, 10 Drawing Figures

APPARATUS FOR COMPENSATING VARIATIONS OF DISTANCE

The present invention relates to apparatus for compensating for variations in the distance between an object or load suspended from a floating support and the sea floor therebelow.

Such variations in distance are due to heaving of the floating support of vessel. It is unnecessary to expand on the purpose and interest of compensating for heaving. It is sufficient to note that in most cases the lowering of load onto the subaqueous floor or removal therefrom, the maintenance of a constant bearing force on a drill bit and like, which are controlled from aboard the floating support subjected to heaving, give rise to problems which make the use of a compensation system virtually mandatory.

In numerous cases motion and force compensation systems have been devised and at times employed. Such systems are illustrated in U.S. Pat. No. 3,718,316, 3,714,995, 3,469,820, 3,309,065, 3,285,574, 3,259,371, 3,158,209, 3,158,206, 3,151,686, 2,945,677 and 2,945,676. Apparatus in service do not seem to be entirely satisfactory. The present invention will be disclosed in the background of prior art attempts, having reference to:

FIGS. 1 and 2 of the accompanying drawings which are diagrammatic elevational views illustrating the operating principle of prior art apparatus.

Figures 1, 2, 3:
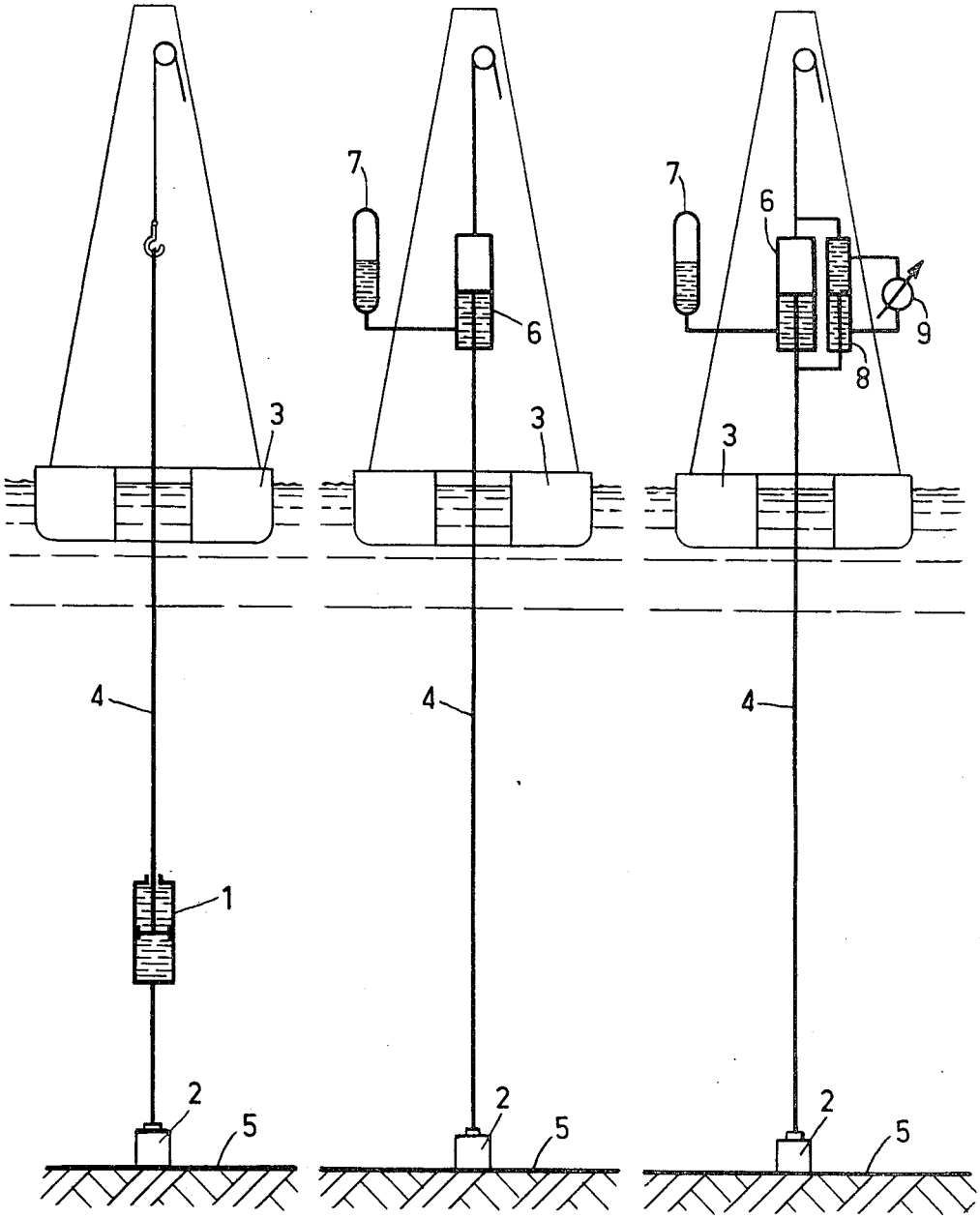
FIG. 3 is a similar diagrammatic elevational view illustrating the operating principle of the present invention.

A classic system is known as the heave slip-joint system comprising a member which is slidable to vary its length, the magnitude of the variations in length being at least equal to that due to heave. The slip joint 1 is disposed at an appropriate height between the load 2 and the floating support 3 on the drill string or cable 4 which interconnects the load and the floating support.

Such a system has been used for a number of years and is satisfactory in certain situations though it falls far short of solving all the attendant problems.

Such a system is used, above all, to eliminate the heaving effect on the load to be lowered in to position on the seabed and also to provide a constant weight on the drill tool.

During the downward movement, the slip joint which is located relatively close to the load also known as the package is operative. The assembly is therefore in abutment and acts as a rigid system. The load is subjected to the same heaving movement as the floating support. To place the package on the seabed, one must choose the moment the periodic movement brings the package into immediate vicinity of the seabed 5, its speed then being small or null.

The lengthening of the drill string or cable permits the slip joint to be quickly brought to its middle position. It is actuated. This system is simple but it has the following drawbacks:

no compensation before the package or load reaches the sea floor;

no adjustment of the bearing force, which force will be equal to or greater than the weight of the package or load. The bearing force, for example during drilling, has to be modified at times. In this case, the assembly has to be hauled to the floating support or vessel to rearrange the rods, making up the drill string, between the slip joint and the drill bit; and difficulty in ascertaining the middle position of the slip joint (the risk of the rods buckling if they abut the sea floor).

Other, so-called "passive compensation" systems are also known and have the following operating principle (FIG. 2): one or two hydraulic cylinder and piston assemblies 6 are provided at the level of the hook, along the string 4 supporting the load or package 2. The hydraulic cylinders and piston assemblies are connected directly to a bank of accumulators 7 whose pressure level is commonly maintained by another bank of "gas" accumulators which provide backup or reserve pressure through a pressure regulator. This backup or reserve pressure is not absolutely necessary but without it the activation of the system is slow because of the limited capacity of the air compressors. Two modes of operation should be mentioned:

(a) during the approach phase, the system acting as a slip joint, that is, in case of preselecting the bearing force against the sea floor 5. The compensation system fulfills its function as soon as the load is in contact with the sea floor, while the preselected bearing force is maintained. The selection of the monent the load or package touch down is just as important here as with the slip joint system above.

(b) during the approach phase, the compensation system is used with the pressure adjusted in the accumulators to the size of the load. This is permissible with heavy loads. As soon as the load is in contact with the sea floor, it is possible, by adjusting the pressure of the gas in the bank of accumulators, to reduce the maintaining force below the weight of the string of rods particularly if the load is to be disconnected on the sea floor.

This system is simple and gives satisfactory results for medium sized and heavy loads once there is contact with the sea floor. Yet it has the following drawbacks:

no fine compensation before the load contacts the sea floor; and difficulty or impossibility to achieve compensation with samll loads.

There are also known compensation systems which combine a passive compensation means adapted to apply on the string of rods a force tending to balance the load and proportional thereto and an active compensation means serving to control both the position of the load and the force on the string of rods at all times. Such a technique is exemplified by U.S. Pat. No. 3,912,227 to Meeker et al.

According to the Meeker et al patent the compensation system comprises passive compensation means comprising a cylinder and piston assembly supplied by an accumulator and active compensation means comprising a single action cylinder and piston assembly connected to a hydraulic supply unit controlled on the basis of several parameters.

In the Meeker et al patent, to insure the maintenance of the load in a predetermined position with respect to the sea floor or to insure the displacement of the load with respect to the sea floor at a predetermined velocity the so-called position mode of compensation is employed, which mode comprises controlling the hydraulic fluid pressure carried to the hydraulic cylinder of the "active" system as the function of two parameters concurrently, viz, the heaving velocity and the position of the piston of the "active" cylinder and piston assembly with respect to its cylinder body. Additionally, in order to maintain a predetermined force on the string of rods after the load has been lowered into position, in the preferred embodiment, the two parameter mode of compensation is put out of service and a so-called pressure mode is employed which consists of adjusting the direction and flow rate of the hydraulic fluid conveyed to the active hydraulic system as a function of a single parameter which is the pressure difference across the piston of the active cylinder and piston assembly. It should be noted that the object of the active compensation means is to apply a predetermined force on the tool fixed at the end of the set of rods and adapted, for example, for drilling, but there is no suggestion of depositing a load on the sea floor. Futhermore, such a system has a certain number of drawbacks:

The use of a single-action cylinder and piston assembly for active compensation requires a relatively high rated power. Passive compensation afforded by the system is constant and unchanged whether during the lowering of the load or after the load has been brought into position assuming that the apparatus of the Meeker et al patent is to be utilized for lowering loads on to the sea floor) which is a drawback if the load is of light weight.

Furthermore, the operation of a pressure compensation mode for maintaining a predetermined force on the string of rods after the load has been placed on the sea floor is the cause of poor control of the force exerted on the string of rods due to the efficiency of the hydraulic cylinder and piston assemblies. This especially is the reason why the Meeker et al. system is unadaptable for depositing loads, especially small loads, on the sea floor.

An object of the invention is the provision of a system combining passive and active compensation free from the above drawbacks.

According to the invention, apparatus for compensating for variations in the distance between an object suspended from a floating support and the sea floor therebelow is provided for controlling the movement of the object connected to the floating support relative to the sea floor, comprising passive compensation means comprising at least one piston and cylinder assembly connected to a pressure accumulator and functioning as a spring, and active compensation means having a piston and cylinder assembly for compensating for residual vertical oscillations or heave and operative as a function of a first parameter which is the position of the piston with respect to its cylinder body and a second parameter which is the velocity of the floating support with respect to the sea floor, characterized in that the active compensation means comprises a double-action piston and cylinder assembly arranged in parallel with the passive compensation means, chambers in the active cylinder on opposite sides of its piston being connected to a hydraulic control means operable as a function of said parameters whereby the direction and flow rate of the hydraulic fluid for the active cylinder and piston assembly is a function of the said parameters.

In case a predetermined force is to be applied on the string of rods after the lowering of an object into position, said apparatus further comprises means for comparing the force exerted on the object by the floating support with a preselected control force, and means for applying the resulting difference hydraulic fluid direction and flow rate control means disposed in the supply line for the double-action cylinder and piston assembly of the active compensation means.

According to a preferred embodiment, the passive compensation means includes at least two pressure accumulators maintained at different pressures for providing two different compensation levels, means selectively connecting the double-action cylinder and piston assembly with one of the accumulators from the other at the moment the object is lowered into place so as to afford powerful compensation during the lowering of the object and a reduced compensation after the object is in place.

Other features and advantages of the invention will become apparent from the following description given merely by way of example with reference to the remaining figures of drawings in which:

The principle of the invention illustrated diagrammatically in FIG. 3 comprises so-called passive or passive operated compensation means including the accumulator 7 and passive cylinder and piston assembly 6, described above, is associated in parallel with active or actives operated compensation means which adds or substracts a variable force and comprises one or more double-action cylinder and piston assemblies 8 controlled by a hydraulic control means 9.

Figure 4:
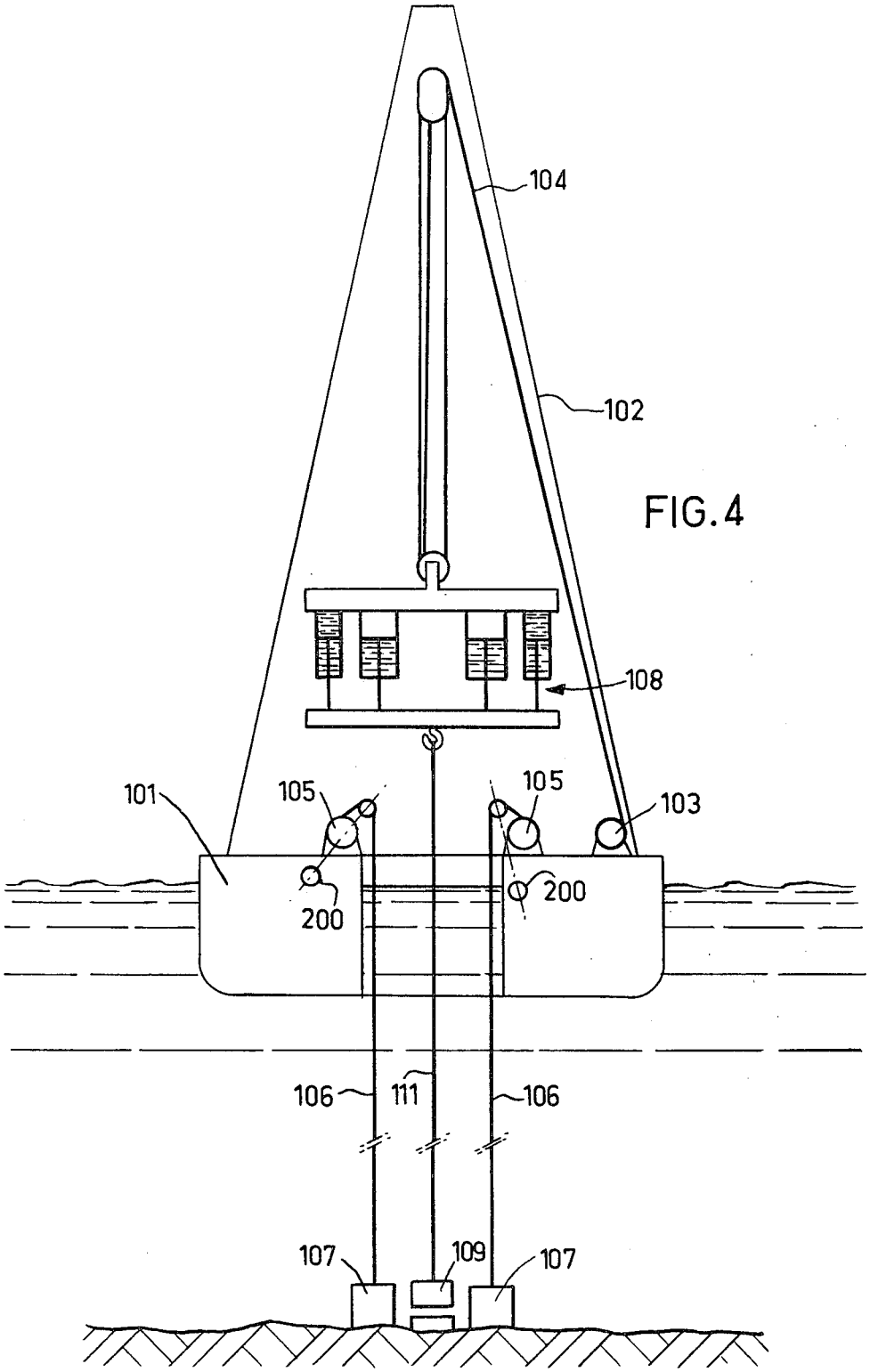
FIG. 4 is a diagrammatic elevational view of an embodiment of the apparatus according to the invention.

The apparatus is shown in greater detail in FIG. 4 illustrating diagrammatically a barge 101 which is the floating support and carries a derrick 102, drawworks or winch 103 with its cable 104, drawworks or winches 105 for guide lines 106 attached to dead weights 107 and a compensation unit 108. Generally, four guide lines 106 are disposed at the corners of a square about the string of rods 111; two lines (disposed diagonally) are provided with tachymetric dynamos 200. When the barge is experiencing heaves the compensation unit enables the package or load 109 to be suspended in the water motionlessly from the string of rods 111. The operation of the drawworks or winch 103 enables the package or load 109 to be displaced with respect to the sea floor.

Figure 5:
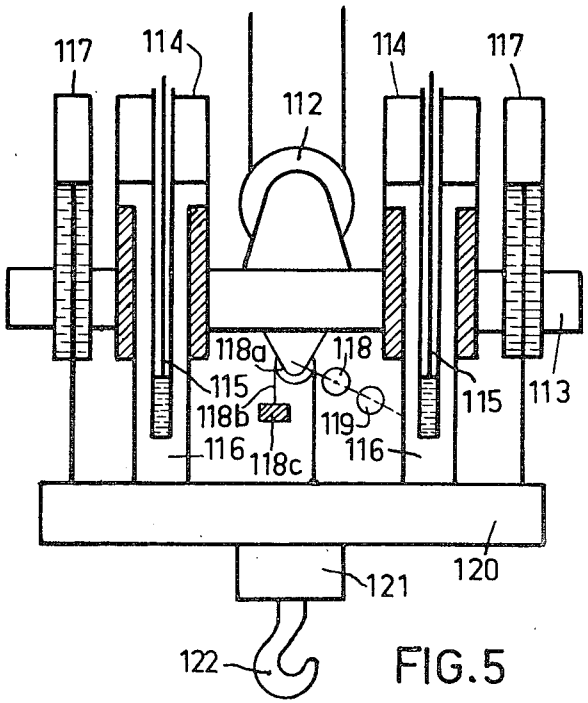
FIG. 5 is a schematic view of the active compensation unit.

The compensation unit, illustrated in greater detail in FIG. 5, essentially comprises a travelling block 112, a support member 113, two single-action passive cylinder and piston assemblies including an inner cylinder 115 in the piston rod 116, two active double action cylinder and piston assemblies 117, a tachymetric dynamo 118 for measuring the speed of the movable support member 120, a synchro resolver 119, a force measuring weighing unit 121, and the hook 122. The tachymetric dynamo 118 is connected to a gear **118*a* on the support member 113 and connected to the support member 120 by a chain 118*b* tensioned by a counterweight 118*c***.

Figure 6:
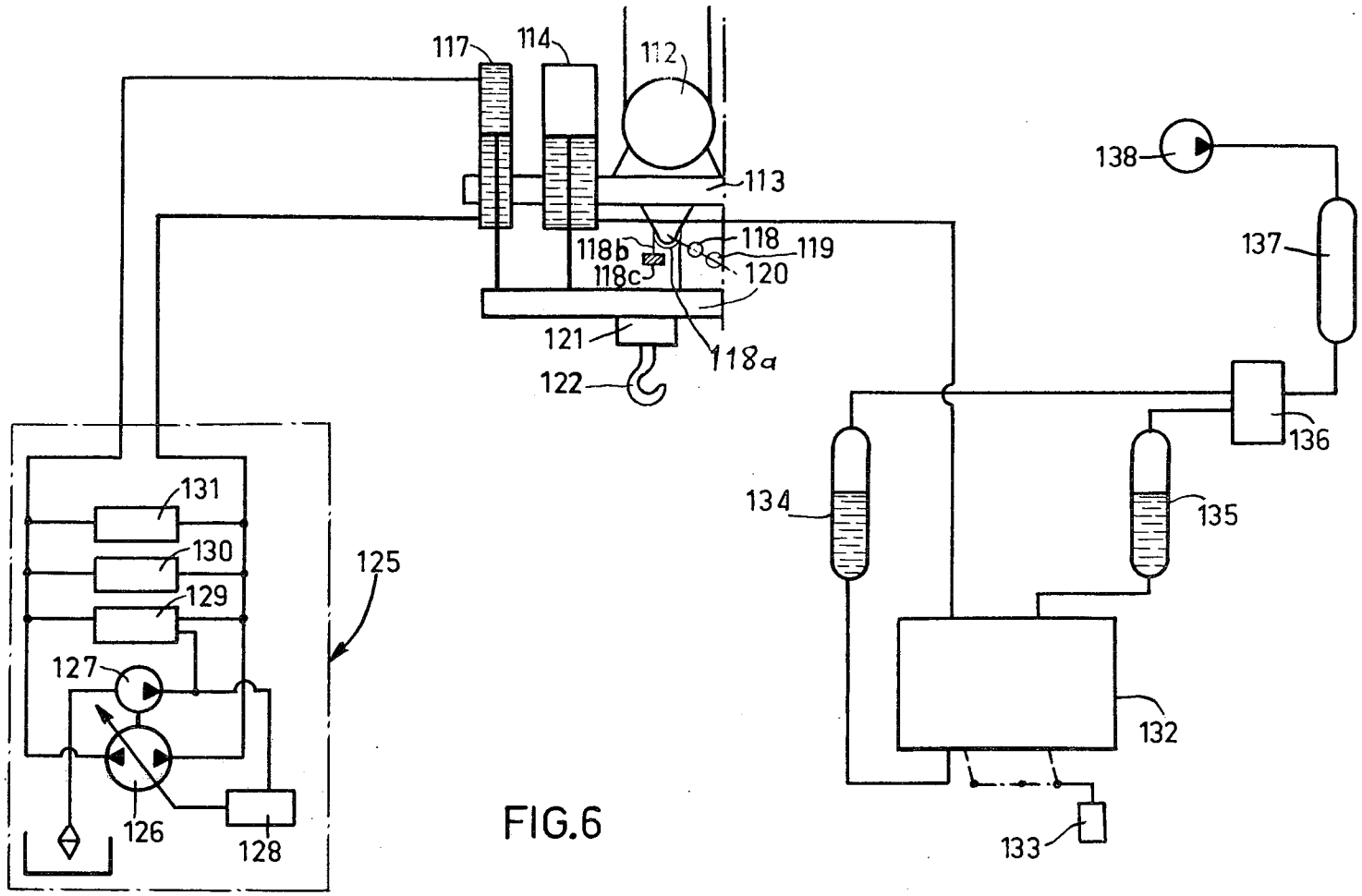

The entire hydro- pneumatic control assembly for the compensation unit is diagrammatically depisted in FIG. 6 and essentially comprises on its active side a variable flow hydraulic control unit 125 comprising an adjustable flow rate pump 126, a feeding up pump 127, a servo valve 128 for controlling the flow rate, a feeding up valve unit 129, safety valve unit 130, recharging circuit 131 and, on the passive side, a bank of low pressure accumulators 134, a bank of high pressure accumulators 135, a pressure selecting means 132 with a pilot hydraulic cylinder 133, means 136 for rapidly recharging gas into the accumulator bank from the bank of reserve accumulators 137 maintained at a constant pressure by a compressor 138. The pilot hydraulic cylinder 133 is actuated by a selonoid valve 133' which is operated by a manually operable push button (not shown).

Figure 7:
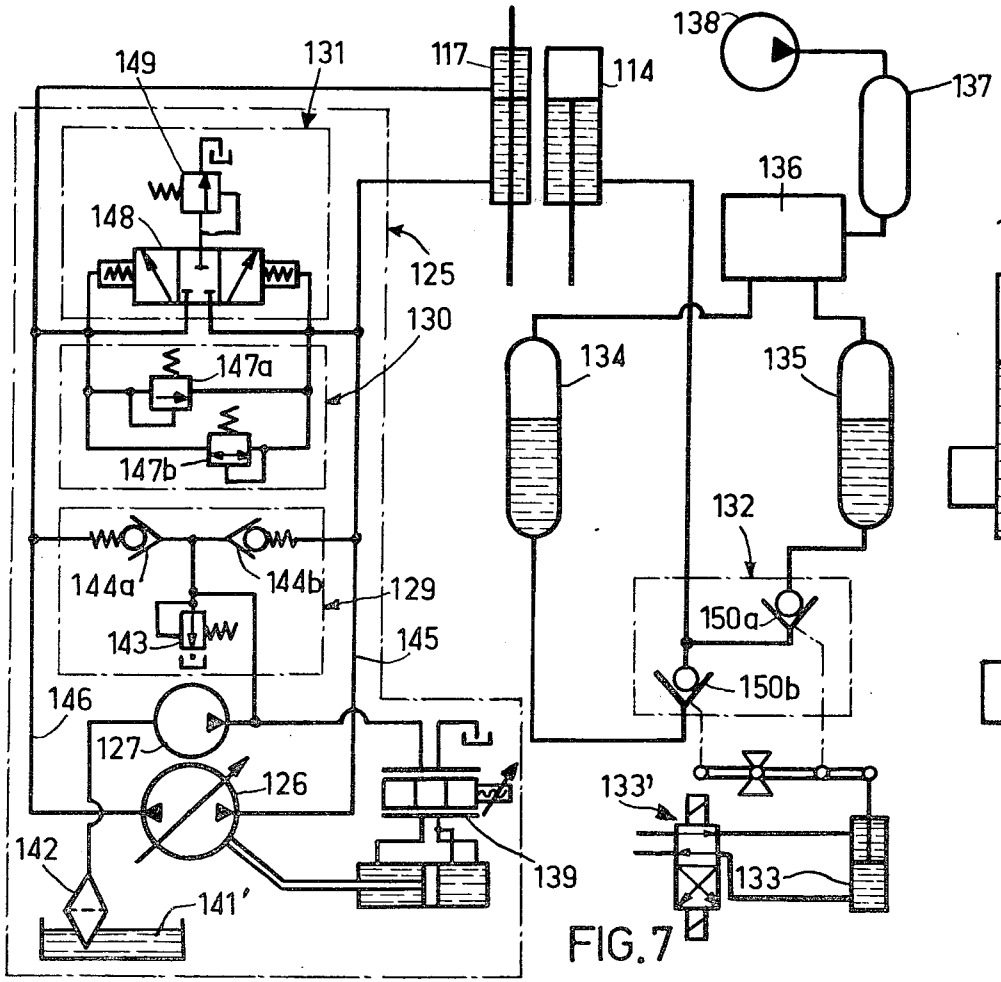
FIGS. 6 and 7 are diagrammatic views of the overall hyro-pneumatic control assembly.

FIG. 7 shows in greater detail the hydropneumatic control assembly in FIG. 6, particularly the variable flow hydraulic control unit 125 and the pressure selecting unit 132.

The variable flow hydraulic control unit 125 comprises, in addition to the adjustable flow rate pump 126 and the feeding up pump 127, a liquid tank 141, a strainer 142 dipping into the liquid in tank 141 and provided with a filter and connected to the feeding up pump 127. The discharge of the feeding up pump 127 supplies both the adjustable flow rate pump 126 through a servo valve 128 and two chambers of the double-action and piston assemblies cylinder 117 via feeding up valve unit 129. Said feeding up valve unit 129 comprises a safety valve 143 and two feed valves 144*a* and 144*b* operating in opposite directions, and two conduits 145, 146 which are also connected to the two discharge orifices of the adjustable flow rate pump 126. The conduits 145 and 146 are connected through a safety valve unit 130 including safety valves 147*a* and 147*b* which operate in opposite direction.

The regenerating or recharging circuit 131 which is arranged in parallel with the safety unit comprises a selector 148 for changing hydraulic fluid and a drain valve 149.

The pressure selecting unit 132 comprises two valves 150*a* and 150*b*, the first connected to the high pressure accumulator 135 and the second to the low pressure accumulator 134, and both discharging into the passive single-action cylinder and piston assembly 114.

Figure 8:
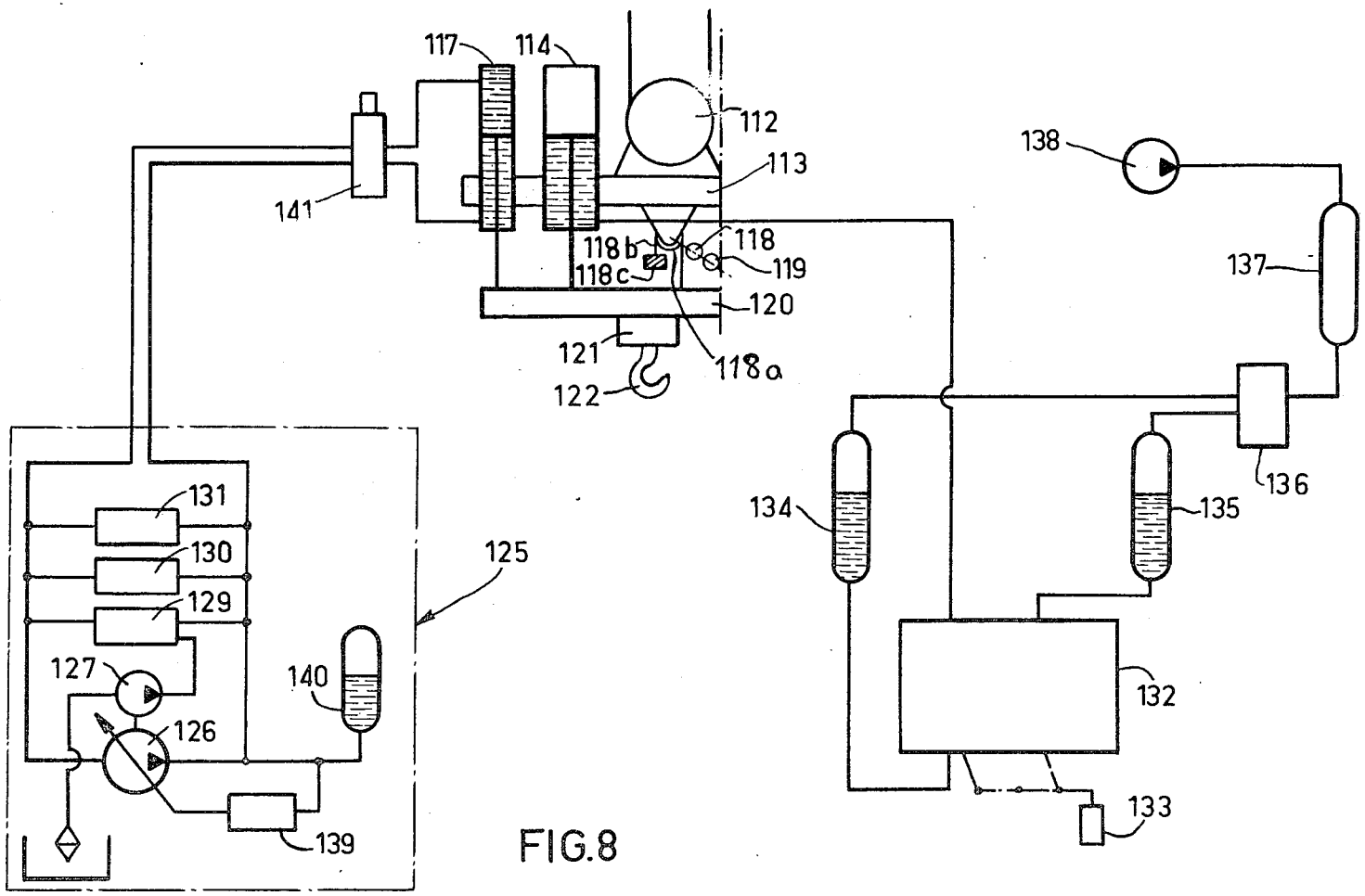
FIG. 8 is a diagrammatic view of an alternative embodiment of the overall control assembly of FIG. 6.

In the modified embodiment shown in FIG. 8 the apparatus comprises, in the active system, a variable flow hydraulic control unit 125 comprising an adjustable flow rate pump 126 maintaining the pressure in the high pressure line, a feeding up pump 127, a pressure maintaining servo valve 139, a feeding up valve unit 129, a safety valve unit 130, a recharging or regenerating circuit 131, an accumulator 140, which compensates for the response time of the adjustable flow rate pump 125 and a servo valve 141' mounted on the compensation unit. The passive system of this embodiment is identical to the previous one.

Figure 9:
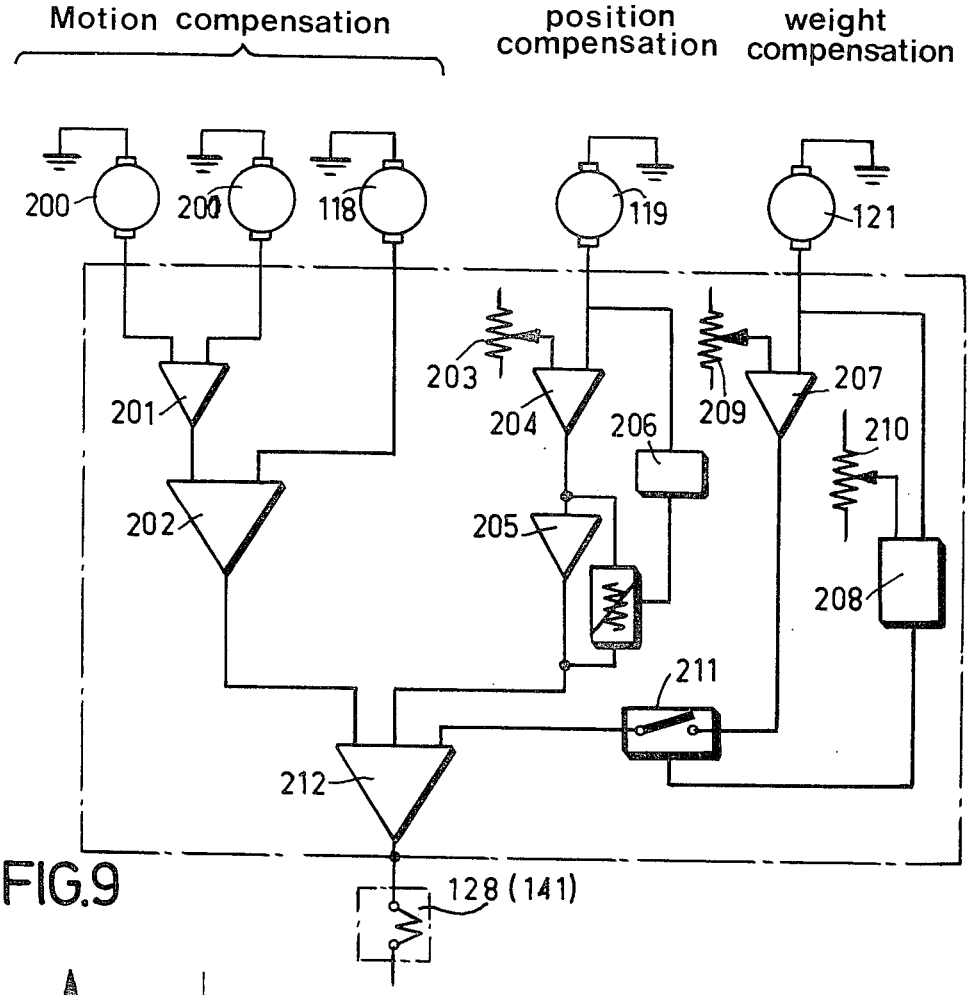
FIG. 9 is a circuit diagram for an embodiment of control means for the variable flow hydraulic control unit of the apparatus.

FIG. 9 shows a simplified circuit diagram of an embodiment of the actuating means for the variable flow hydraulic control unit by means of different parameters.

The control means comprises an operational amplifier 201 receiving electrical signals from two tachymetric hynamos 200. The operational amplifier 201 is coupled to a second operation amplifier 202 receiving electrical signals issued from the tachymetric dynamo 118.

A synchro resolver 119 delivers, after processing, a signal compared with a reference signal produced by a potentiometer 203 by means of an operational amplifier 204 supplying a variable gain amplifier 205 with its gain controlled by a threshold 206 detecting the presence of the piston rod of the active cylinder and piston assembly at its middle position.

The force measuring or weighing unit 121 supplies a signal directed to an operational amplifier 207 comparing this signal with reference signal produced by a potentiometer 209. The potentiometer 209 displays the preselected force on the string of rods. A limiter or detecting means 208 is preset so that its threshold or limit, set by a potentiometer 210, automatically switches on by means symbolically represented by a switch 211 the control of force on the rods of the string.

Signals provided by the amplifiers 202, 205 and 207 are carried to an adder amplifier 212 which actuates the servo valve 128 or 141.

The load to be lowered into place on the sea floor is suspended from a string or rods. The high pressure in the bank of accumulators 135 is selected by adjusting the air pressure so as to balance the weight of the load in the water with the movable support member. The lower pressure in the bank of accumulators 134 is selected by adjusting the air pressure so as to obtain a desired maintaining force on the string of rods after the load is in place.

When the package is at a specified distance from the sea floor (last rod in position) which distance is at least as great as the total heave compensation travel, the compensation command is given by manual actuation from the control and monitoring console.

The position mode entails the sensing of the deviation between the reference position (mid-point of the movement range) and the high position of the piston rods, by the synchro resolver 119. An electrical command signal to the servo valve 128 or 141 ensues which controls the flow of hydraulic fluid to the active cylinder and piston assembly which gradually brings the piston rods to the mid-point of their movement ranges.

When the movable support member reaches mid-point of its movement range (detected by the synchro resolver 119) the velocity mode progressively prevails over the position mode, the operation of the position mode being at a level sufficient to correct for drift due to errors of measurement and external parameters (tides and the like).

Thereafter and throughout the entire operation of lowering the load or package into position, three types of control or modes of operation are employed:

(1) The position mode: comparison between the reference voltage provided by the potentiometer 203 (at the midpoint of the compensation travel) and the voltage produced by the synchro resolver 119 operates the servo volave 128 or 141 through operational amplifiers 204, 205, 212.

(2) The velocity mode: comparison between the average voltage provided by the two tachymetric dynamos 200 (velocity of the floating support with respect to the sea floor) and the voltage furnished by the tachymetric dynamo 118 (velocity of the piston rods with respect to their cylinder bodies) operates the servo valve 128 or 141 through operational amplifiers 201, 202, 212.

(3) The force mode: comparison between the reference voltage furnished by the potentiometer 209 (desired force on the string or rods to maintain the load in place after it has been lowered into position, preselected value) and the voltage furnished by the force measuring unit 121 through operational amplifiers 207 and 212 and the limiter or threshold switch 211 actuates servo valve 128 or 141 when the force drops below the set value. In fact, throughout the descent of the package and when it is motionless, but not yet in place, only the first two modes are operative, the force mode having no affect.

Figure 10:
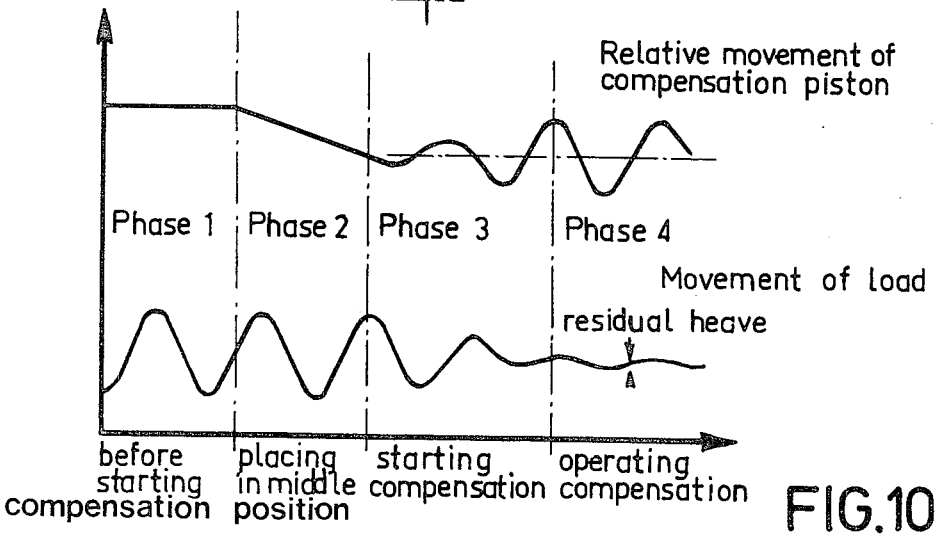
FIG. 10 shows graphs of the movement of pistons and the load during lowering with the compensation system according to the invention.

FIG. 10 depicts the transition period which has four successive stages:

Stage I: Rest position, the load is secured to the string of rods, the passive and active compensation means are not yet operative.

Stage II: Command compensation. The command for compensation brings the movable support member to its middle position.

Stage III: Sensing of the middle position (by the synchro resolver 119) gradually brings the velocity mode into operation, as explained above.

Stage IV: Velocity mode in full operation. The position mode is thereafter effective only to prevent drifting.

When the package is motionless with respect to the sea floor (that is, irrespective of heaving of the floating support) the drawworks 103 lowers the package to within several centimeters of the sea floor.

The command to drop the package to the sea floor is given manually by means of a viewing system (television, diver, or the like) or an automatic sensing system (sonar, various types of sensors or the like).

At the same time the drawworks 103 unwinds the cable to drop the load onto the sea floor.

The laying of the load on the sea floor causes the force exerted by the hook to drop below the reference force (detected by the force measuring or weighing unit 121) which brings in to operation the force mode which prevails over the other two modes. Constant tensile force (at the preselected value) is thus maintained on the rods of the string.

The modified embodiment of FIG. 8 is of special interest in the force mode as it enables the response time in the hydraulic circuits to be diminished. In this embodiment the servo-valve 139 is substituted to the servo-valve 128 of FIG. 6 and its purpose is to maintain the pressure with the accumulator 140. The servo valve 141 positioned as close as possible to the active cylinder and piston assembly 117 is constructed and arranged to effect changes of direction and rate of flow of the hydraulic fluid. The adjustable flow rate pump 126 has a single flow direction and its flow rate drops to zero when there is no fluid demand. When there is a call for hydraulic fluid by the servo valve 141 the pump 126 and the accumulator 140 compensate immediately therefor.

The foregoing procedures relate more particularly to the laying of a package on a sea floor. To lift the load from the sea floor the procedure is the same except that the passive compensation operates in the opposite direction, i/e. change over from a small compensation force to a large compensation force.

The invention is of course not limited to the embodiments described and illustrated herein but covers all modifications and variations not departing from the spirit and scope of the appended claims.

What we claim is:

1. Apparatus for compensating for variations in the distance between an object suspended from a floating support and a sea floor therebelow in order to control the movement of the object with respect to the sea floor, comprising:

passive compensation means including a passive cylinder and piston assembly connected to a first pressure accumulator and functioning as a spring, a further pressure accumulator operative at a pressure different from said first pressure accumulator, and means for selectively connecting said passive cylinder and piston assembly to said pressure accumulators, thereby providing two different compensation levels, whereby said means for selectively connecting said passive cylinder and piston assembly to said pressure accumulators is operative during the descent of said object toward the sea floor to provide powerful compensation and to provide slight compensation after said object reaches the sea floor;

active compensation means including an inactive double-action cylinder and piston assembly arranged in parallel with said passive cylinder and piston assembly, the piston of said active cylinder and piston assembly dividing its cylinder into two variable chambers, said active cylinder and piston assembly compensating for residual vertical oscillations and operating as a function of a first parameter defined by the position of the piston rod of said active cylinder and piston assembly relative to its cylinder and a second parameter defined by the velocity of the floating support with respect to the sea floor; and hydraulic control means operative in accordance with both said parameters and connected to said chambers for varying the direction and flow rate of hydraulic fluid to said active cylinder and piston assembly as a function of said parameters.

2. Apparatus according to claim 1, for maintaining a predetermined force on a string of rods suspending the object from the floating support after the object has been lowered into place on the sea floor, comprising means for comparing the force exerted by the floating support on the object with a preselected control force, means for applying the resultant difference on said hydraulic control means for regulating the direction and flow rate of hydraulic fluid in a supply circuit for said active cylinder and piston assembly.

3. Apparatus according to claim 2, wherein said supply circuit comprises both a hydraulic control unit for maintaining the pressure (in said active cylinder and piston assembly) in association with servo control means and another accumulator, and servo valve means at the level of the active cylinder and piston assembly.

4. Apparatus according to claim 1, further comprising first means for providing an electrical signal proportional to the difference between the velocity of the floating support relative to the sea floor and the velocity of the piston rod of said cylinder and piston assembly relative to its cylinder, second means for providing an electrical signal proportional to the deviation between the middle position of the piston rod compensation travel and the actual position of the piston rod relative to its cylinder, third means for providing a signal porportional to the difference between the force exerted on a hook on a movable support for supporting string of rods for suspending the object from the floating support and a preselected force, the three electrical signals produced by said first, second and third means being fed to an adder amplifier supplying a servo valve means of said hydraulic control means for controlling the direction of flow and rate of flow of hydraulic fluid to said active cylinder and piston assembly, said first, second and third means comprising a force measuring or weighing unit operatively disposed between the hook for supporting said string of rods and the movable support, an operational amplifier for receiving an electrical signal from said force measuring or weighing unit and an electrical signal produced by a reference potentiometer, and threshold detecting means adapted to automatically couple the operational amplifier to the adder amplifier when the output of the former reaches a preselectable level.

* * * * *